United States Patent [19]

Bidwell

[11] Patent Number: 4,773,981

[45] Date of Patent: Sep. 27, 1988

[54] APPARATUS FOR IMPROVING INTERNAL COMBUSTION ENGINE EFFICIENCY

[75] Inventor: Howard Bidwell, Granby, Mass.

[73] Assignee: Stephen Masiuk, Granby, Mass.

[21] Appl. No.: 64,057

[22] Filed: Jun. 19, 1987

Related U.S. Application Data

[60] Division of Ser. No. 821,342, Jan. 22, 1986, which is a continuation of Ser. No. 623,499, Jun. 22, 1984, abandoned, which is a continuation-in-part of Ser. No. 402,970, Jul. 29, 1982, Pat. No. 4,484,444.

[51] Int. Cl.[4] ..... C25G 9/00

[52] U.S. Cl. ..... 204/266; 204/129; 204/265; 204/262; 123/3; 123/DIG. 12; 60/272; 60/275; 60/282; 60/320

[58] Field of Search ..... 123/3, DIG. 12; 204/129, 265, 266; 60/272, 275, 282, 320

[56] References Cited

U.S. PATENT DOCUMENTS

| | | | |
|---|---|---|---|
| 1,333,838 | 3/1920 | Csanyi | 204/129 |
| 1,941,816 | 1/1934 | Stuart | 204/129 |
| 2,365,330 | 12/1944 | Carmichael | 123/DIG. 12 |

*Primary Examiner*—R. Andrews

*Attorney, Agent, or Firm*—Ross, Ross & Flavin

[57] ABSTRACT

An apparatus comprising an electrolysis cell having a plurality of electrically energized gas conduits is combined with an internal combustion engine.

7 Claims, 5 Drawing Sheets

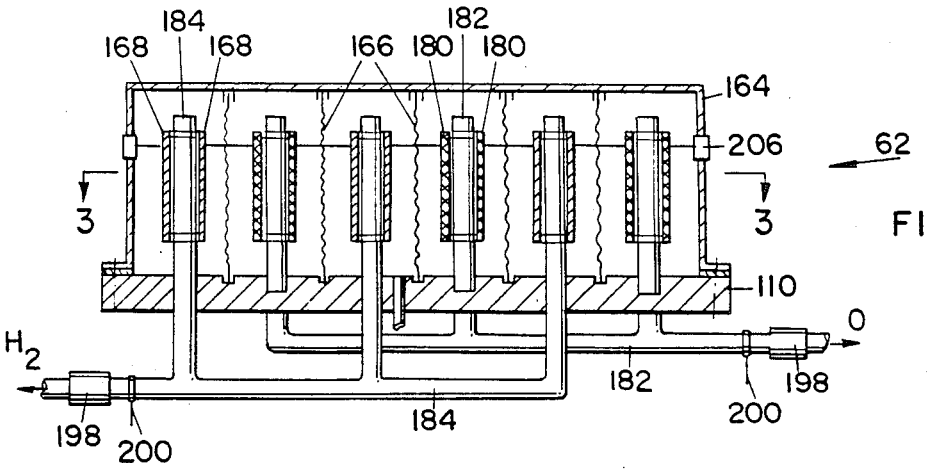
FIG. 6.
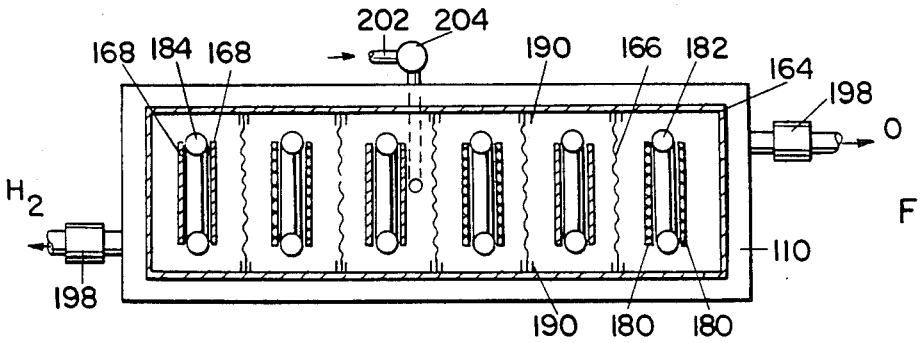
FIG. 7.
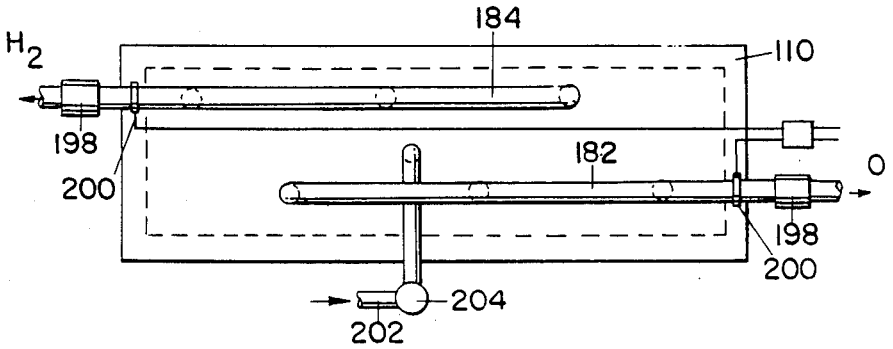
FIG. 8.
FIG. 9.
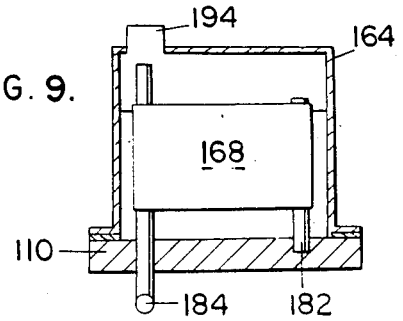
FIG. 10.
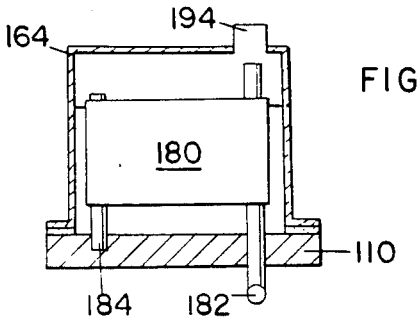

APPARATUS FOR IMPROVING INTERNAL COMBUSTION ENGINE EFFICIENCY

CROSS REFERENCES TO RELATED APPLICATIONS

This is a division of application Ser. No. 821,342 filed Jan. 22, 1986, which is a continuation of my copending application, Ser. No. 623,499, filed June 22, 1984, now abandoned, which is a continuation-in-part of my copending application, Ser. No. 402,970, filed July 29, 1982, now U.S. Pat. No. 4,484,444 issued Nov. 27, 1984.

BACKGROUND OF THE INVENTION

1. Field of the Invention

This invention teaches a method of and apparatus for increasing the overall efficiency of an internal combustion engine by way of reducing the polluting effects of the engine exhaust in the form of burning its non-consumed hydrocarbon content aided by the introduction of charges of auxiliary fresh air into the exhaust flame at the exhaust manifold outlet, while simultaneously propelling an electric current generator for energizing an hydrogen-oxygen gas generator with which to enrich the engine air-fuel intake mixture as well as the engine exhaust gas content.

While minimizing the carbon monoxide content at the exhaust manifold and maximizing the carbon dioxide content, I simultaneously extract the heat and kinetic energies normally emanating from the increased secondary combustion activity due to the induced fresh air. By so maximizing the use of the exhaust energies, my intake mixture is supercharged.

2. Description of the Prior Art

With the exception of equipment using the engine exhaust to propel air-fuel intake mixtures of exhaust-driven turbine type superchargers and heat extracted for use similar to that used in the Prague and other type carburetors and devices, no method or apparatus is known to exist for intensifying the secondary combustion of an engine exhaust in combination with a means for generating hydrogen-oxygen within the vehicle system with which to improve the intake and/or exhaust mixtures.

No method is known for generating hydrogen or oxygen gases by any conventional method or means within any commercial conveyance vehicle of any kind or type to fit the application here presented.

SUMMARY OF THE INVENTION

This invention enhances the composition of the exhaust gases by the feeding of either hydrogen or oxygen or both to change the exhaust gases composition from a carbon monoxide content to a carbon dioxide content, such feeding being directly into the exhaust flame at the exhaust manifold outlet and within the inlet housing of a turbine rotor for creating a secondary combustion activity and sustaining such activity for a sufficiently long period of time and of travel while being supplied simultaneously with a sufficient volume of heat conditioned auxiliary fresh air.

The desired change in the exhaust mixture by way of consuming or otherwise burning the non-consumed hydrocarbons enures at the engine exhaust manifold outlet. I utilize the flame at the outlet to kindle a secondary combustion activity in order to consume or burn the non-burned hydrocarbon portion of the gases exhausted from the engine cylinders and I do this with the aid of an admission of a flow of fresh air to the flame.

This fresh air charge is sufficiently heat-treated so as to avoid any chilling or excessive lowering of the temperature of the engine exhaust gases below that temperature sufficient to cause and sustain the secondary combustion.

The consuming or burning of the hydrocarbon content of the exhaust takes place within the extremely short range of the actual exhaust flame at the precise outlet of the exhaust manifold. The flame is exploited in kindling the secondary combustion activity upon the introduction thereto of the fresh air charge. And while this program is being carried out, a generator energizes an hydrogen-oxygen gas generator by emans of which I improve the engine air-fuel intake and indirectly the gas content of the engine exhaust.

The invention teaches the feature of maximizing the extractable energies of the normally wasted exhaust flame by the inducting of a conditioned charge of fresh air into the flame for attaining a more intensified and prolonged secondary combustion activity and the more complete consumption of the hydrocarbons, all in concert with increasing the hydrogen-oxygen supply.

The invention also teaches a method of heating a controlled flow of a water-alcohol solution by the exhaust gas flow to a steaming state, then blending same with the carbureted air-fuel mixture all to the end of accomplishing a more complete gasification of the carbureted vapors so as to be more completely flammable upon entering the engine cylinders, thereby further reducing fuel consumption as well as minimizing the exhaust polluting effects.

Further, the invention utilizes the increase in energy imparted to the turbine rotor outer blades for drawing fresh air into the inner chamber of the turbine.

The exhaust driven turbine rotor serves to better propel the attached super charger rotor and electrical current low voltage high amperage generator for energizing the hydrogen-oxygen gas generator for supplying the hydrogen gas to the engine intake and the oxygen gas to the engine exhaust flame for accentuating the secondary combustion activity for increasing the force of the exhaust flame impingement on the turbine rotor.

The invention teaches the use of directly attached exhaust powered units, (without extended duct means in between), to obtain direct exhaust "flame" tangential impingement thrust against the perimeter of paddle wheel type vaning of a fresh air cooled and fresh air flow inducing exhaust gas driven double purpose siamese type turbine rotor, the integrally attached and propelled twin rotor part functioning to simultaneously and additionally and separately to receive, heat and supercharge carbureted air-fuel and other engine intake mixtures, all within a common dual compartment assembled into a single component unit that also additionally drives a special type of high amperage low voltage electrical current generator for automatically energizing the herein disclosed special type hydrogen-oxygen gas generator at rates in accordance with engine load and speed.

Heat is additionally applied to the carbureted air-fuel mixture via an exhaust heat exchanger with optional settings respective to temperature degrees and extent and desired control, manual, automatic or otherwise, not shown, as may conform with the desired temperature of the supercharged engine feed mixture via a supercharger and subsequent supercharged mixture cooling within a cooler.

Said cooling within the cooler is achieved by means of liquid coolant flow or air flow as may be selected or employed.

Liquid flow from a reservoir to a heat exchanger to a hydrogen-oxygen gas generator is controlled by a liquid level controller normally located at one side of a gas generator positioned to advantageously control the electrolyte level within the gas generator, preferably feeding the fresh supply centrally through the bottom of the generator base, if of the float control type.

BRIEF DECRIPTION OF THE DRAWINGS

FIG. 1 is a schematic flow line diagram showing the flow direction between the various operatively interconnected components illustrating the basic principles of the invention;

FIGS. 2–5 are showings of a modified form of the invention wherein the turbine rotor 30, generator 63 and supercharger 44 schematically shown in FIG. 1 are combined into a unitary structure with:

FIG. 2 being a part sectional view on line 2—2 of FIG. 3;

FIG. 3 being a view in top plan of the FIG. 2 showing and illustrating the relative arrangement of the components;

FIG. 4 being a view of an alternative type of air volume regulating shutter;

FIG. 5 being a fragmentary view in cross section on line 5—5 of FIG. 2;

FIG. 6 is a side elevational cross sectional view of a simplified hydrogen-oxygen gas generator embodying the invention;

FIG. 7 is a plan cross sectional view on line 7—7 of FIG. 6;

FIG. 8 is a bottom plan view of the FIG. 6 generator; and

FIGS. 9 and 10 are end elevational views as seen from the ends of FIG. 6.

DESCRIPTION OF THE PREFERRED EMBODIMENT

Figure 1:
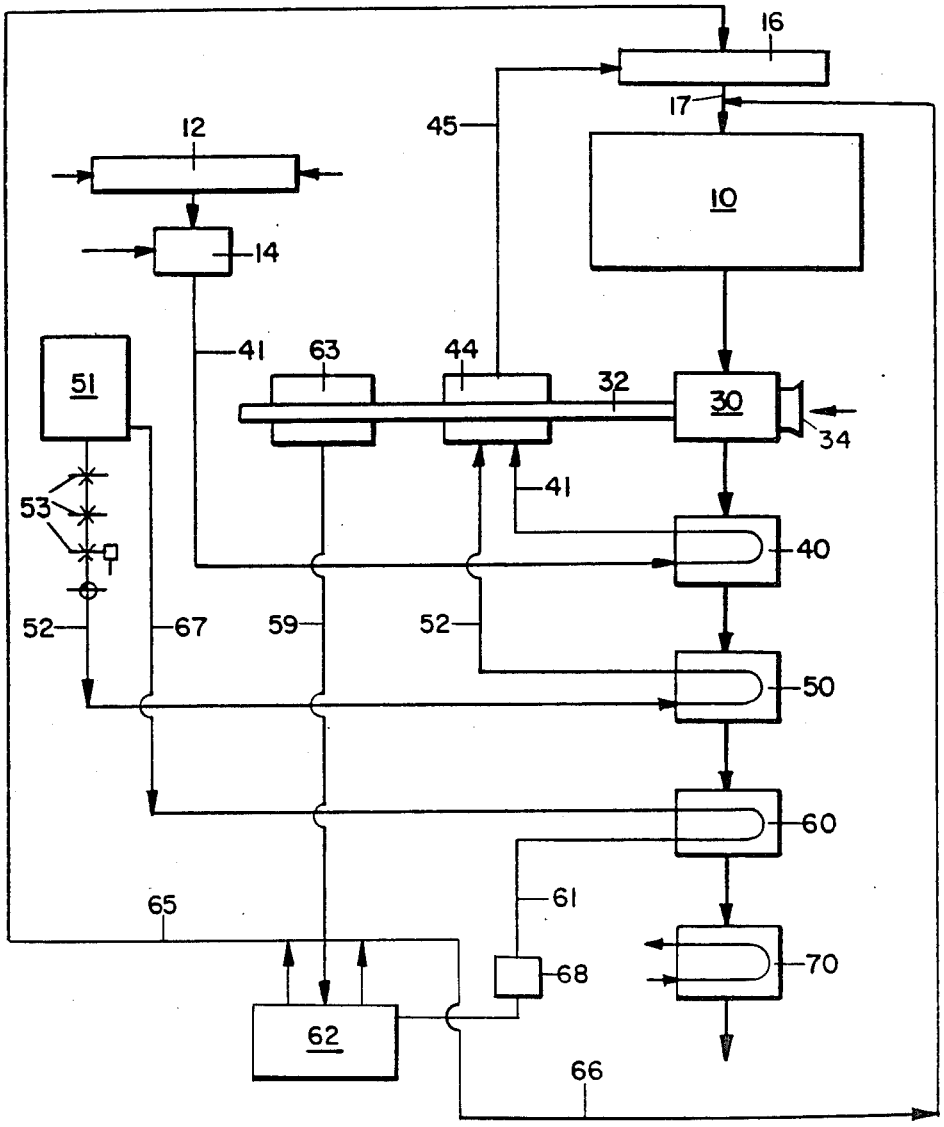

In the schematic flow line diagram of FIG. 1, I have represented the exhaust from the exhaust manifold outlet of an internal combustion engine 10 as being directed via a line 11 to a fresh-air-cooled exhaust-driven turbine rotor 30, the exhaust flame impinging directly against the turbine rotor vaning to impart a rotative motion thereto.

The intake of engine 10 is drawn from an air filter 12 and carburetor 14, via a line 41 through a heat exchanger 40 to an intake supercharger 44 and passed therefrom via a line 45 to the engine intake manifold 16.

A flow of a water-alcohol solution is trickled from a reservoir 51 via a line 52, along which a plurality of controls 53 are disposed for regulating the fluid flow, through a heat exchanger 50 to intake supercharger 44 where the water-alcohol solution is converted to superheated steam.

Controls 53 are automatically activated to the open position when the vehicle ignition key (not shown) is switched to the on position and which automatically returns to the closed position when the key is turned to the off position.

Intake supercharger 44 and an electric generator 63, in line therewith, are jointly driven by means of an air-cooled hollow shaft 32 driven through the rotative motion of turbine rotor 30.

By this means, a generated current from electric generator 63 is supplied via a line 59 to an hydrogen-oxygen gas generator 62. Its generated hydrogen gas is fed into intake manifold 16 via a line 65. Its generated oxygen gas may be selectively fed to the exhaust flame via a line 66 and/or to the line 17 between intake manifold 16 and engine 10.

Liquid flow from reservoir 51 via a line 67 is directed to a heat exchanger 60 and then via a conduit 61 to hydrogen-oxygen gas generator 62 and the flow is controlled by a liquid level controller 68 located adjacent generator 62 in order advantageously to control the electrolyte level within the generator. The controller provides a safety feature so as to prevent an excessively high electrolyte level or flooding by causing a temporary closing of the liquid flow to gas generator 62, not shown.

The carbureted air-fuel mixture is heat conditioned by means of heat exchanger 40 (FIG. 1) and is thence drawn through the intake supercharger by virtue of the rotor vaning and is thence forced through the supercharger outlet and thence to a cooler if such is used, and thence to the engine intake manifold 16. The supercharger inlet and outlet connections may be provided at the top side of the supercharger housing, but, if desired, may be independently arranged at different angles including disposition from below the housing in order to suit installation facilities.

In the FIGS. 2–5 showings, I have illustrated a typical compact construction wherein the turbine rotor, supercharger and generator of the FIG. 1 schematic have been physically combined into a unitary structure which is connected directly to the engine exhaust manifold.

Its hollow, air-cooled drive shaft 332 is disposed in parallelism with the engine crankshaft and the exhaust driven turbine rotor 330 is fixed thereto. Intake supercharger rotor 344 is also mounted on drive shaft 332 in a back-to-back relationship with turbine rotor 330, both rotors being housed within a housing 331.

A common plate 329 may be disposed, if desired, between the housing half-parts comprising housing 331 (FIG. 2) for imparting a rigidity to the housing structure and for providing a divider wall between the rotors.

Drive shaft 332 is supported by strategically positioned antifriction bearings 333 well outboard of opposite sides of the housing having free full shaft bore air entrance openings at each end unobstructed.

Turbine rotor 330 is operative within the exhaust flame and its rotative motion is imparted to supercharger rotor 344 as well as to a low voltage, high amperage DC current type generator 363, also mounted on drive shaft 332, which supplies current directly to the hydrogen-oxygen gas generator 62 of FIG. 1.

Figure 4:
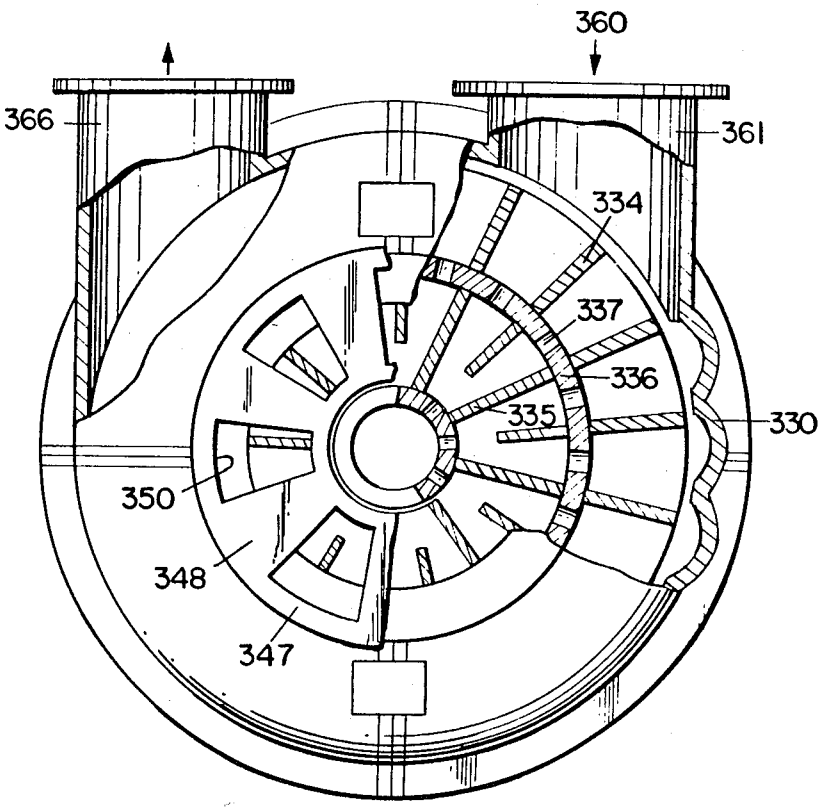

As best shown in FIG. 4, the exhaust flame is discharged from exhaust manifold outlet 360 and through turbine housing inlet 361 and into the rotor to impinge on outer vaning 334, thereby causing the rotor rotation with the exhaust flow following a U-shaped course toward a discharge outlet 366.

Figure 2:
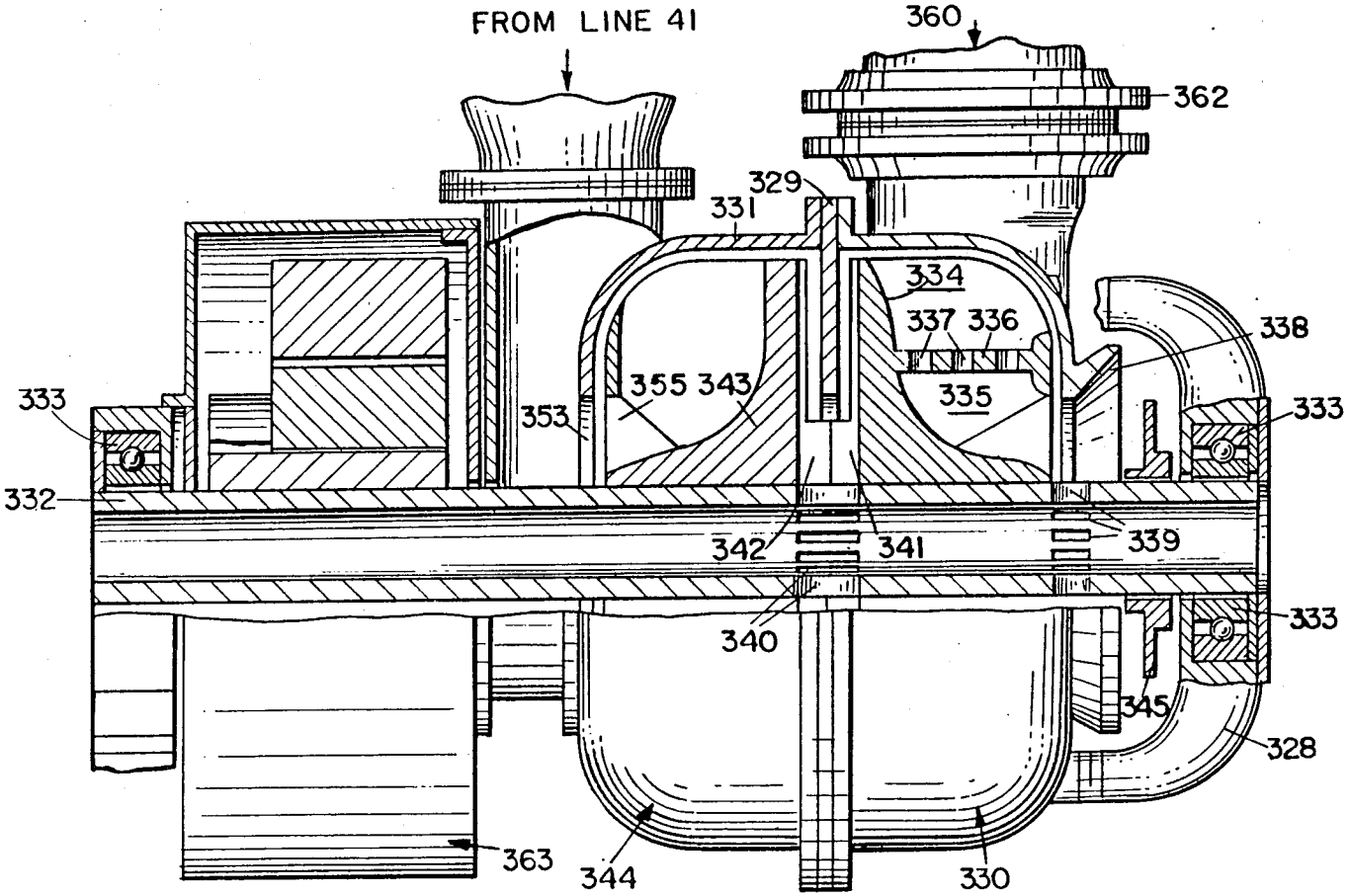

As shown in FIG. 2, exhaust driven turbine rotor 330 will be seen to comprise outer vaning 334 and inner vaning 335 separated from each other by a cylindrical shell 336 provided with through perforations 337.

The exhaust flame impinges directly against outer vaning 334 to cause the rotor to rotate at high velocity within the high temperature exhaust flame.

This rotation causes inner vaning 335 to draw a flow of fresh air through an air inlet 338 (FIG. 2), which fresh air is highly agitated and heat conditioned by the inner vaning before being charged through perforations 337 for blending with the exhaust flame and for travel through the U-shaped course of travel to the housing discharge outlet, the blending resulting in a secondary combustion activity for the burning of the non-burned hydrocarbons in the exhaust gases while simultaneously keeping the various parts of the rotor from excessively heating.

The rotor is cooled by air currents drawn into the housing via a series of peripherally-arranged air ports 339 in drive shaft 332 (FIG. 2).

Other air ports 340 in drive shaft 332 allow a cooling of back vaning 341 and 342 on the respective backsides of rotor 330 and rotor 344, to further aid the blending process.

If desired, the outer surfaces of the housing half-parts could be ribbed for assisting in the cooling process.

As aforesaid, the fresh air is introduced into the turbine rotor 330, initially flowing over the outer vaning surfaces while being blended into the flame through the rotor rotation, helping to avoid a lowering of the exhaust flame temperature to such a degree as not to deter the secondary combustion activity, but yet sufficient enough so as to increase the propelling force on the outer vaning thereby generating additional energy.

The charge of fresh air admitted to the rotor via air inlet 338 is controllable, manually or automatically, not shown, by a slidable shutter 345 mounted on drive shaft 332. FIG. 2.

Alternately, an air volume regulating means may be employed, as shown in FIG. 4, same consisting of an inner fixed plate 347 fixed over air inlet 338 (FIG. 2) which is provided with a series of openings 350 and an outer rotatable plate 348 provided with a matching series of openings 351 whereby rotation of plate 348 may effect a maximizing or a minimizing of the through openings to air inlet 338 of FIG. 2.

Figure 3:
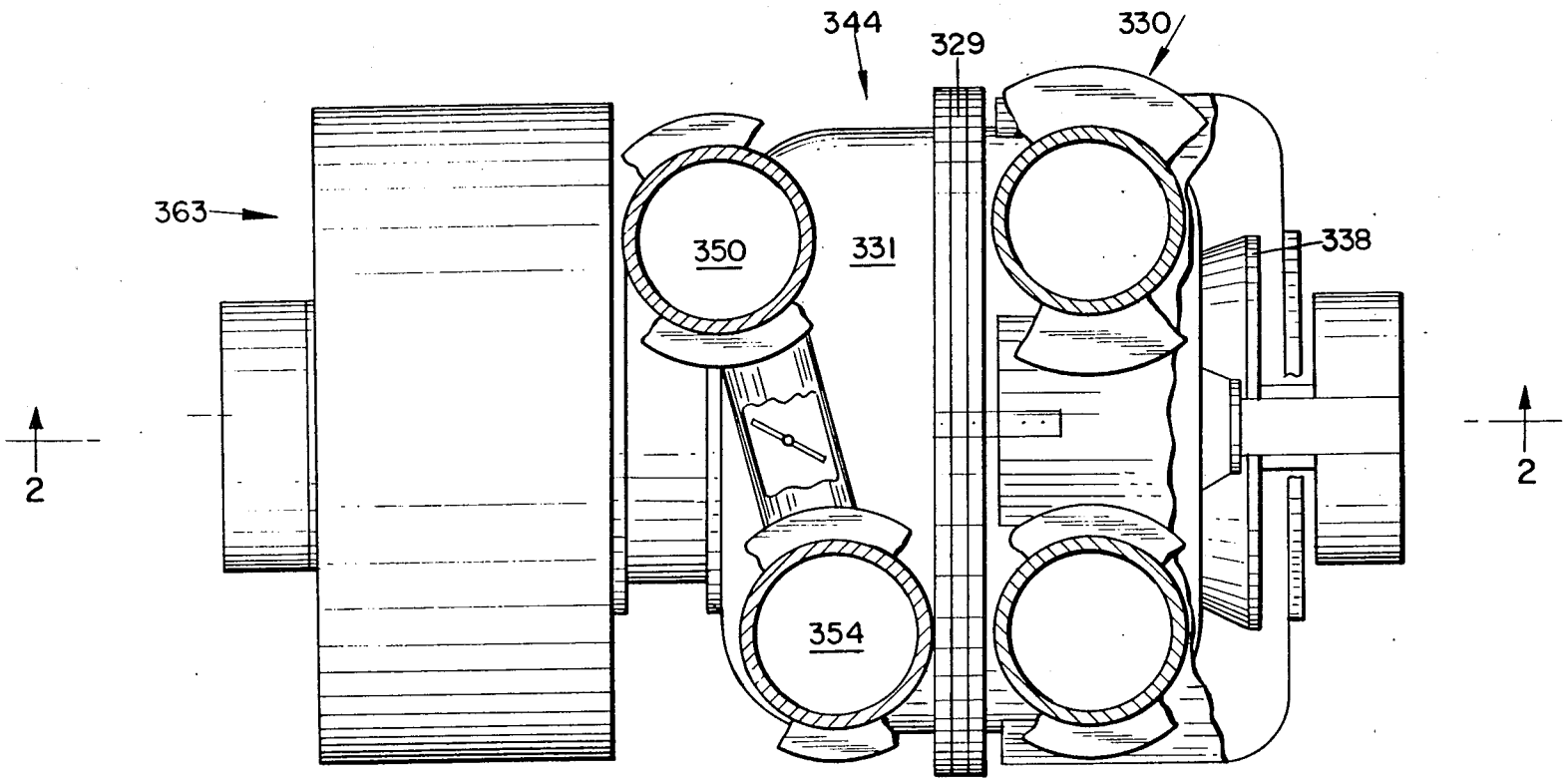

In FIG. 3, I have shown in plan the inlet 350 to the supercharger rotor 344 for receiving the carbureted air-fuel mixture from duct 41 (FIG. 1), and then through the inlet 353 (FIG. 2) and outwardly through outlet 354 (FIG. 3) by the supercharger vaning (FIG. 2).

Figure 5:
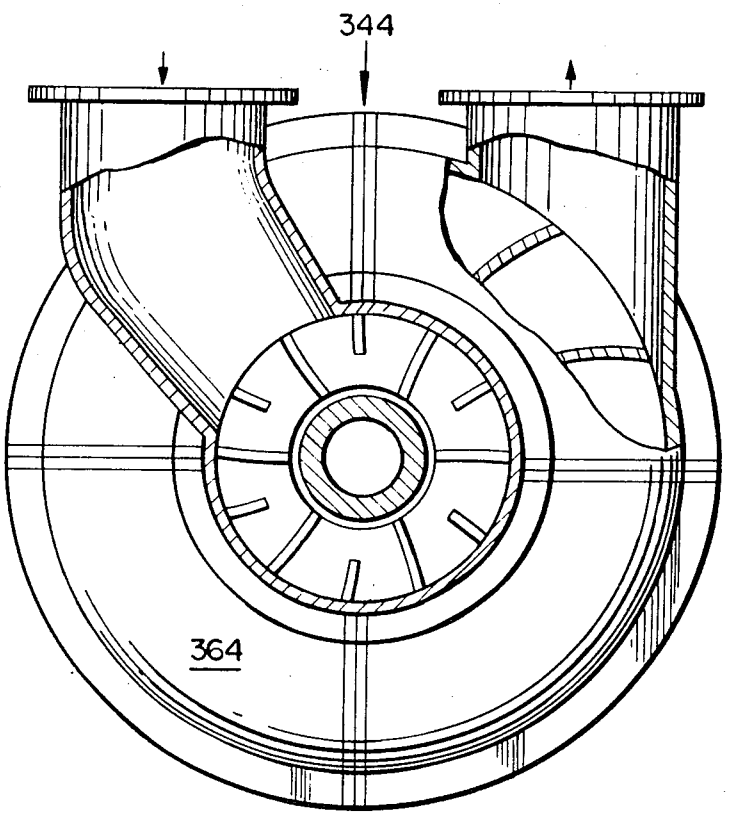

In FIG. 5 is shown supercharger rotor back flange of rotor 344 with the carbureted air fuel inlet 382 to the rotor and the vaning 346 via supercharger housing inlet 382.

As the same time rotor operation will cause an induction of outside air through both open ends of hollow drive shaft 332, thereby cooling the drive shaft and its bearings and also being drawn therefrom by virtue of the inner vanes 335 of rotor 330 via elongated air ports 340 in shaft 332 and also additionally further by virtue of impeller vaning 342 on the backside of supercharger rotor 344 and also vaning 341 on the backside of exhaust turbine rotor 330 via the elongated air ports 340 in drive shaft 332 thereby simultaneously cooling the backside of the supercharger rotor and the backside of the exhaust turbine rotor and supplementing the other cooling means as well as aiding in the blending of fresh air into the exhaust flame.

Operationally, the exhaust flame from the exhaust manifold outlet 360 enters the exhaust rotor housing inlet 362 (FIG. 2) directing the flame with a thrust against outer vaning 334 causing the rotor to rotate along with the rotor of supercharger 344 and further causing generator 363 to rotate, with the generated current flowing to gas generator 62 (FIG. 1) and the electrolyte solution to flow therefrom.

With the engine operational, the hydrogen gas within the generator begins to flow freely and directly to the engine intake manifold, free of any flow regulating controls or devices and at a flow rate in accordance with the engine speed. Simultaneously, the oxygen gas freely flows to the engine exhaust manifold, preferably up-stream close to the exhaust outlet. This flow is likewise free of any flow regulating controls or devices. During engine idling or at no-load speeds, the hydrogen and oxygen generating rates are reduced responsively to the low electric current flow from the electric generator, also operating at an idling speed under the most simplified arrangement.

Upon the exhaust turbine rotor rotation, outside fresh air is drawn into the rotor through the intake shuttered opening by virtue of the rotor vaning and at a rate in accordance with the impelling thrust force expended on the rotor outer vaning. In this way, the so-induced auxiliary air is vigorously agitated and heat conditioned prior to being forced through the multiplicity of relatively small bore perforations of the rotor inner chamber enclosure cylindrical shell hot wall so as to be uniformly widely spread and distributed between the various vanes of the outer rotor vaning, and directly into the high temperature exhaust flame blast. This immediately excites an increased additional secondary combustion activity and results in an increased gas volume expansion and velocity thrust force against the rotor outer vaning, while simultaneously burning the unburnst hydrocarbons so as to increase the carbon dioxide content. This all takes place within the high temperature environment of the exhaust blow-torch-type flame thrust, not otherwise possible at a rate according to the engine speed as controlled by the usual accelerator or throttle means.

In FIGS. 6–10, I have shown a typical type of six volt hydrogen-oxygen gas generator, the component 62 as shown in FIG. 1.

In the side elevational view of FIG. 6, I have shown by means of single-line cross hatching a plurality of cathode (−) plates 168 and by means of double-line cross hatching a plurality of anode (+) plates 180.

These plates are all disposed within a single gas generating chamber and are suitably separated from each other by means of woven asbestos curtains 166.

Each plate, save for the end plates, has a two-way double duty electrolytic directional flow relationship with its adjacent plates of opposite polarity on both sides thereof. Such arrangement allows a simplified structure occupying a minimum of space.

FIG. 8 shows, in a bottom plan view, looking from the underside of the FIG. 7 showing, separate negative (−) hydrogen coveying metallic ducts 184 and positive (+) oxygen conveying ducts 182. These ducts also serve as electric current conductors to respective cathode (−) plates 168 and anode (+) plates 180.

End views in cross section (FIGS. 9 and 10) illustrate the arrangement of alternately mounted cathode plates 168 and anode plates 180 with means for separately conducting the hydrogen and oxygen from the generating chamber via ducts 182 and 184 respectively. These also serve as electrode plate mounting holders and as electrical current conductors to the electrode plates and ducts 182 and 184 from the gas generating chamber to the selected system of gas distribution to the engine intake and/or to the secondary combustion means.

All three hydrogen and oxygen has generating cells are shown in FIG. 6 as being incorporated on a single common non-current conductor insulator type base 110 on which all three anode plates 180 and all three cathode plates 168 are assembled in alternating order, i.e. anode −1, cathode −1, anode −2, cathode −2, anode −3, and cathode −3, as viewed in said Figure from left to right.

Preferentially, both anode and cathode plates are formed of nickel plated iron with knurling on the active working faces and are secured to respectuve supporting metal tubular posts. One post serves as the gas outlet tube, such as by a tongue and groove mating or by tubular clips, or by brazing or welding, as may be desired. The gas outlet tube of each cell serves as one supported post while the other supporting post for each electrode plate is suitably secured to base 110 and serves no other purpose in this application.

The gas outlet electrode plate holding post of each electrode plate is arranged to pass downward directly through the base to which it is sealed by any suitable means for continuing and connecting each gas type tubular conduit outlet with each other similar gas type outlet tube.

Such allows a continuous generated gas outlet flow arrangement,as shown in FIG. 8 wherein the exterior portions of the respective separate hydrogen and oxygen gas conducting conduits, represented in FIG. 6, are here shown as offset, but only for purposes of clarity.

The iron electrode plates for both the anode and cathode mountings may be relatively thin and of rectangular shape and having concave side edges for clamping to the supporting tubular posts by means of such as clamp screws, not shown.

Asbestos curtains 166 separating the anode and cathode plate compartments may be of pressed metal framed edging dimensioned to fit snugly into suitable grooving or channels 190 provided in the upper side of base and also channels provided in the inner sides and roof of a cover 164 which may be clamped to the base after the final assembly of all of the gas outlet conduit tubular and supporting posts and electrode plates and curtains 166.

The non-gas conductive electrode supporting posts may be of tubular form with lower solid ends threaded to screw into threaded recesses in base 110, not shown.

Cover 164 may be of suitable molded plastic, glass or coated metal and may be secured to the base by means of a suitable liquid leak proof gasket and clamp down or by means of flange bolts, not shown.

The top of cover 164 may have gas tight raised sections 194 located over each gas outlet tubular post so as to allow for longer or higher gas outlets above the normal electrolyte level.

Each hydrogen and oxygen exterior conduit is provided with a non-electrical current conducting coupling 198 outside or beyond electrical current supply connections 200.

Electrolyte liquid or water may be gravity fed to the hydrogen-oxygen gas generating chamber from the elevated reservoir 51 (FIG. 1) or other means via the conduit 67 (FIG. 1), to a float control feeder 204 (FIGS. 6 and 8) strategically located close to one side of the generator, and thence through the base from the underside near a center point via a conductor.

Whereas the FIG. 6 showing illustrates relatively wide spacings between electrodes for purposes of clarity, in actual practice the spacing between the electrodes and curtains may be relatively close. Also, the length or height of the electrodes may be greater than has been illustrated.

For 12 volt operation, a duplicate arrangement may be extended lengthwise in a side-by-side series relationship, and proportioned dimensionwise so as to accommodate to various application needs.

The operation is fully automatic without any need for regulating controls since gas generation does not begin until the secondary combustion of the engine exhaust has reached an intensity sufficient to drive the electric generator at a speed sufficient to generate an electric current of a wattage for operating the hydrogen-oxygen gas generator at a capacity rate in direct relationship with the engine load-speed operation.

I claim:

1. In combination with an internal combustion engine, a hydrogen-oxygen gas generator for separately and selectively supplying hydrogen and oxygen to the engine for improving the intake and exhaust mixtures comprising:

a housing, an insulated base enclosed within the housing, a multiplicity of alternately-arranged electrode plates of positive polarity and electrode plates of negative polarity, a plurality of positive gas conducting conduits energized by electric current of positive polarity for conducting electric current to the respective electrode plates of positive polarity, a plurality of negative gas conducting conduits energized by electric current of negative polarity for conducting electric current to the respective electrode plates of negative polarity, the positive conduits supporting the plates of positive polarity, the negative conduits supporting the plates of negative polarity, each electrode plate being separated by framed woven asbestos partitions and being supported by the respective gas conducting conduit, a plurality of channels each for receiving and positioning a respective one of the partitions, the plates of positive and negative polarity being supported by the gas conducting conduits above the insulated base.

2. In the generator of claim 1 including:

an electrolyte feed and level control means for precluding overfeeding within the generator.

3. In the generator of claim 1 including:

a gas collecting manifold for each of the respective hydrogen and oxygen gases.

and a means for limiting the flow of electrical current to the generator in accordance with the engine speed or load.

4. In the gas generator of claim 1 including:

a gas driven turbine rotor driven by the engine exhaust gas for generating electrical energy for energizing the gas generator.

5. In the gas generator of claim 4 including:

means for feeding the generated oxygen gas into the engine exhaust gas for intensifying the magnitude of heat energy of the gas for more completely burning the carbon monoxide content and increasing the electrical energy output for the energizing of the gas generator and increasing the generation of the hydrogen-oxygen gases.

6. In the gas generator of claim 1 including:

means for feeding the generated hydrogen gas to the intake of the engine for reducing the fuel intake and air intake.

7. In the gas generator of claim 4 including:

means for heating the electrolyte in the gas generator with the engine exhaust gas for effecting a maximizing of the gas generator capacity.

* * * * *